US006550217B2

(12) United States Patent
Heung-Bin

(10) Patent No.: US 6,550,217 B2
(45) Date of Patent: Apr. 22, 2003

(54) SAFEGUARDING DEVICE OF A GLASS DOOR SERVING FUNCTIONS OF WINDSHIELD, SOUNDPROOFING AND SAFETY

(76) Inventor: Im Heung-Bin, 101-1601 Shinhan Apartment, 78-1 Hyosungl-dong, Kyeyang-gu, Inchon-shi (KR)

( * ) Notice: Subject to any disclaimer, the term of this patent is extended or adjusted under 35 U.S.C. 154(b) by 0 days.

(21) Appl. No.: 10/087,115

(22) Filed: Mar. 1, 2002

(65) Prior Publication Data

US 2002/0121071 A1 Sep. 5, 2002

(30) Foreign Application Priority Data

Mar. 3, 2001 (KR) ..... 2001-5717 U

(51) Int. Cl.[7] ..... E06B 1/04; E06B 5/00; E06B 9/00

(52) U.S. Cl. ..... 52/800.11; 62/800.13; 62/800.14; 62/800.12; 62/204.51

(58) Field of Search ..... 52/223.6, 223.7, 52/204.71, 204.597, 716.8, 800.12, 800.13, 800.14, 800.11, 204.51; 296/93

(56) References Cited

U.S. PATENT DOCUMENTS 2,867,860 A * 1/1959 Anderson ..... 52/204.51
3,363,390 A * 1/1968 Crane et al. ..... 52/716.8
3,965,638 A * 6/1976 Newman ..... 52/786.13
4,448,430 A 5/1984 Bright ..... 277/184
4,813,733 A 3/1989 Gustafson et al. ..... 296/93
4,866,895 A * 9/1989 Hlavaty ..... 52/208
4,914,888 A * 4/1990 Hanson ..... 52/768
5,887,391 A * 3/1999 Shoup ..... 52/202
6,223,497 B1 5/2001 Ohtake ..... 52/800.14
6,318,036 B1 * 11/2001 Siudzinski et al. ..... 52/207
6,338,227 B1 * 1/2002 Finke ..... 52/207

* cited by examiner

*Primary Examiner*—Jeanette Chapman

(57) ABSTRACT

Disclosed is a safeguarding device of a glass door serving functions of windshield, soundproofing and safety, in which a buffering member for providing a soft feeling with an elastic buffering member is assembled on an edge side of the glass door, and a weather strip is assembled on the frontal edge surface of the buffering member. The safeguarding device of the present invention is comprised of: a fixing member 10 having substantially U-shaped cross section, the fixing member 10 having an fitting space 11*b* with which an edge side of the glass door 15 is assembled, the fitting space 11*b* having a silicon space 11*a* formed on an inner side wall thereof, the silicon space 11*a* being filled with silicon, wherein two assembly grooves 10*a* having T-shaped cross section is formed by assembly ribs 10*b* having L-shaped cross section, on a side opposite to the fitting space 11*a;* a buffering member 20 having another assembly ribs 20*g* assembled with the assembly grooves 10*a,* the assembly ribs 20*g* being formed on a side 20*c* thereof having T-shaped cross section, the buffering member 20 having two buffering spaces 20*b* of almost a rectangular shape which are spaced by a central partitioning wall 20*a* formed on a central area thereof; and a weather strip 30 assembled with a fixing groove 20*d* having T-shaped cross section, so as to provide airtight sealing.

2 Claims, 5 Drawing Sheets

SAFEGUARDING DEVICE OF A GLASS DOOR SERVING FUNCTIONS OF WINDSHIELD, SOUNDPROOFING AND SAFETY

BACKGROUND OF THE INVENTION

1. Field of the Invention

The present invention relates to a safeguarding device of a glass door serving functions of windshield, soundproofing and safety, and more particularly, to a safeguarding device of a glass door, in which a buffering member for providing a soft feeling with an elastic buffering member is assembled on an edge side of the glass door, and a weather strip is assembled on the frontal edge surface of the buffering member.

2. Description of the Prior Art

A general glass door such as a safety door made of a reinforced glass has, as shown in FIG. 5, an elastic rubber or a synthetic resin for providing an elasticity, and ribs for providing windshield effect by sealing air tightly. (Such a glass door has been disclosed in Japanese Utility Model Publication NO. H2-103489 published on Aug. 16, 1990, and in Korean Utility Model Laid-Open NO. 97-002105 published on Jan. 24, 1997)

However, such a product provides insufficient effect of sealing, elasticity and soft feeling, and causes noise due to the interference of the projecting ribs for windshield when the door is opened and closed.

SUMMARY OF THE INVENTION

The present invention has been made to overcome the above-mentioned problem of the prior art, and accordingly, it is the object of the present invention to provide a safeguarding device of a glass door serving functions of windshield, soundproofing and safety, in which the windshield and soundproofing effect is enhanced by improving the airtight sealing, and the wound in finger of a child caused when the door is closed can be prevented by the buffering force of itself.

The above object of the present invention is accomplished by a safeguarding device of a glass door serving functions of windshield, soundproofing and safety, the safeguarding device comprising: a fixing member having substantially U-shaped cross section, the fixing member having an fitting space with which an edge side of the glass door is assembled, the fitting space having a silicon space formed on an inner side wall thereof, the silicon space being filled with silicon, wherein two assembly grooves having T-shaped cross section is formed by assembly ribs having L-shaped cross section, on a side opposite to the fitting space; a buffering member having another assembly ribs assembled with the assembly grooves, the assembly ribs being formed on a side thereof having T-shaped cross section, the buffering member having two buffering spaces of almost a rectangular shape which are spaced by a central partitioning wall formed on a central area thereof; and a weather strip assembled with a fixing groove having T-shaped cross section, so as to provide airtight sealing.

BRIEF DESCRIPTION OF THE DRAWINGS

The above-mentioned objects and the feature of the present invention will be more apparent by describing the preferred embodiment of the present invention by referring to the appended drawings, in which.

DESCRIPTION OF THE PREFERRED EMBODIMENT

Hereinbelow, the present invention will be described in greater detail with reference to the accompanying drawings.

Figure 1:
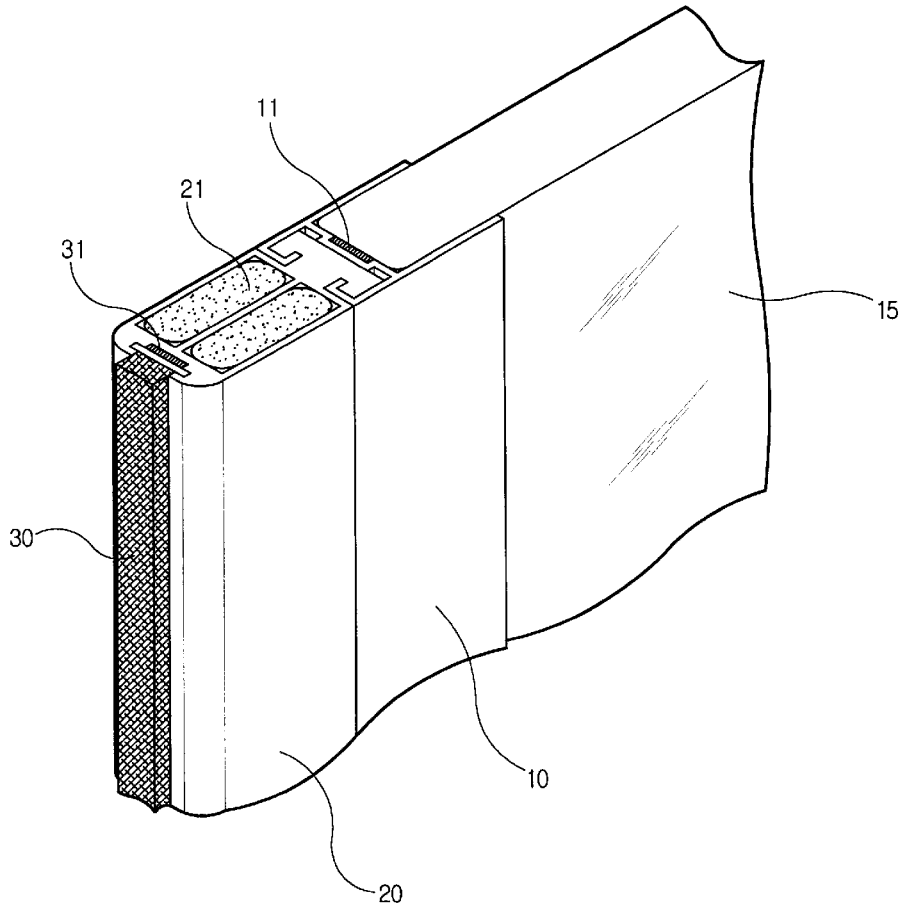
FIG. 1 is a perspective view of the present invention showing the assembled state thereof.
Figure 2:
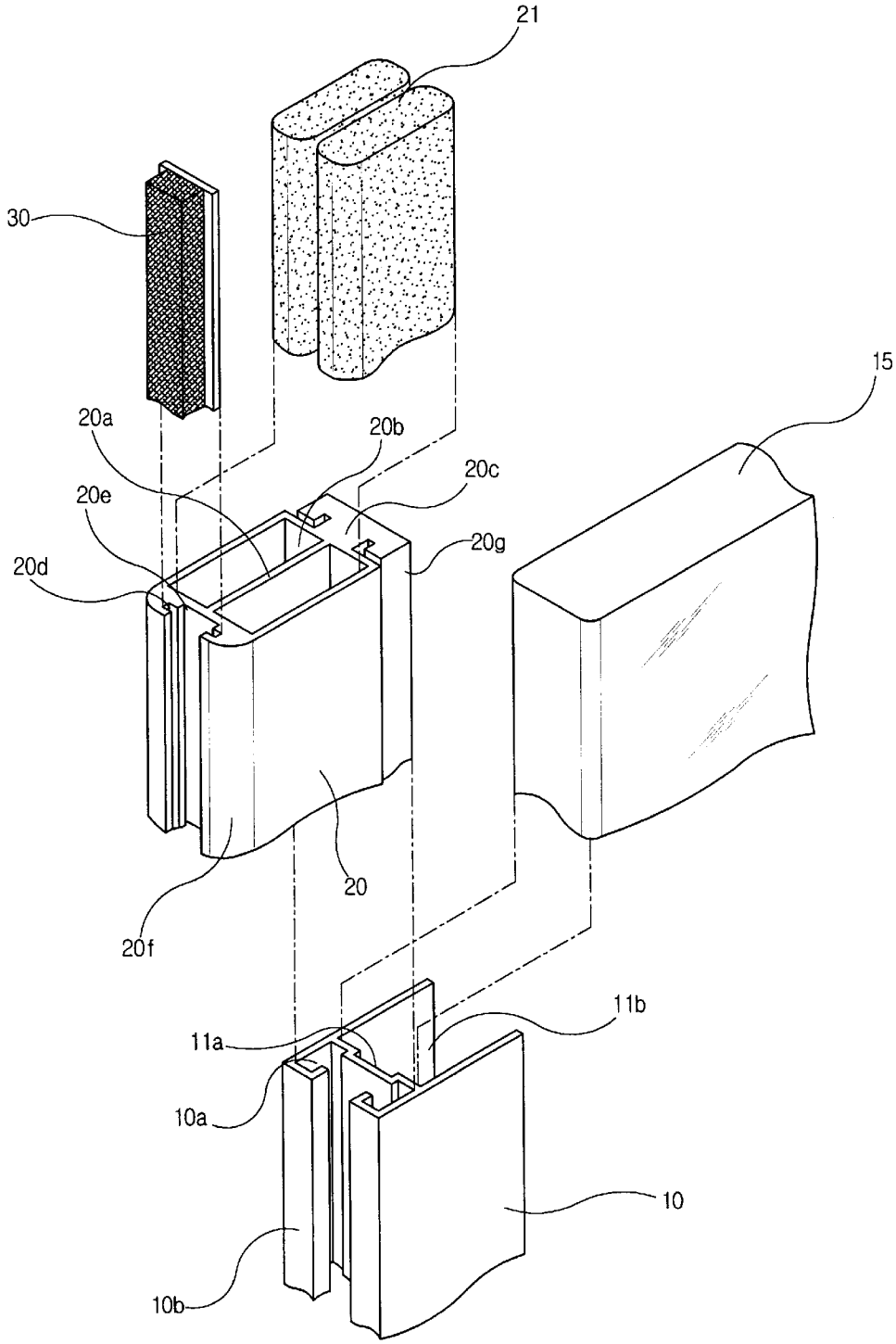
FIG. 2 is an exploded perspective view of the present invention.

FIGS. 1 and 2 are perspective views of the present invention respectively showing the assembled state and the exploded state thereof.

The device according to a preferred embodiment of the present invention for safeguarding a glass door which serves functions of windshield, soundproofing and safety, is mainly comprised of three members, i.e., a fixing member 10 fixed on the glass door 15, a buffering member 20 assembled with the fixing member 10, and a weather strip 30 inserted into the frontal edge side, of the buffering member 20.

The fixing member 10 having substantially U-shape is assembled with the frontal edge side of the glass door 15 through the fitting space 11*b* thereof. Silicon is filled in a silicon space 11*a* formed on the inner side wall of the fitting space 11*b*. On a side of the fixing member. 10, which is the opposite side of the fitting space, assembly ribs 10*b* having L-shaped cross section are formed so as to form two assembly grooves 10*a* having T-shaped cross section.

On the middle area of the buffering member 20, two buffering spaces 20*b* are formed, which are partitioned by a central partitioning wall 20*a* and have a cross section of almost a rectangular shape. Buffering materials 21 such as a sponge are inserted into the buffering space 20*b*, which offer a self-buffering force. Further, assembly ribs 20*g* assembled with the assembly grooves 10*a* of the fixing member 10 are formed on one side 20*c*, which has T-shaped cross section, of the buffering member 20. On the other side opposite to the side 20*c* of the buffering member 20, assembly groove 20*d* having T-shaped cross section is formed.

The weather strip 30 is inserted into the assembly groove 20*d* so as to provide the airtight sealing effect.

In greater detail, the fixing member 10 having the U-shaped cross section has the T-shaped assembly grooves 10*a* provided for the assembly with the buffering member 20, and the L-shaped assembly ribs 10*b* are formed symmetrically on both sides of the respective assembly grooves 10*a*. Accordingly, the buffering member 20 is fixed steadfastly by the assembly grooves 10*a* and the assembly ribs 10*b*.

Meanwhile, L-shaped assembly ribs 20*g* for being fixed with the assembly grooves 10*a* of the fixing member 10 by insertion are formed on one side 20*c* of the buffering member 20. The fixing groove 20*d* assembled with the weather strip 30 is formed on the frontal edge side 20*f* of the buffering member 20, and the fixing groove 20*d* is formed with an adhesive agent recess 20*e* filled with adhesive agent so that the weather strip 30 inserted into the fixing groove 20*d* is fixedly bonded.

The buffering spaces 20*b* respectively formed on both sides of the central partitioning wall 20*a* is filled up with the buffering material 21 such as a sponge for providing a restoring force caused by the elasticity of itself. Therefore, the buffering member 20 has the self-elasticity due to the buffering material 21 inserted into the buffering spaces 20*b*, thereby keeping a stable expanding and shrinking continuously.

Furthermore, both of the edges 20*f* of the frontal side of the buffering member 20 are rounded so as to prevent the interference to the outside. In the glass door used for entrance and exit according to the present invention, the buffering member 20 is preferably made of soft rubber, silicon or flexible synthetic resin, and the sponge 21 is preferably made of synthetic resin foam.

As the weather strip 30 is inserted into the fixing grooves 20*d* formed on the frontal edge side of the buffering member 20, the leakage of air through the clink in door can be prevented maximally, which provides the effect that the inflow of wind and noise from the outside is prevented effectively.

In such a situation, the weather strip 30 is fixed steadfastly and the airtight sealing effect of the weather strip 30 can be more improved, by the adhesive agent 31 filled in the adhesive agent recess 20*e* of the fixing groove 20*d*.

The fixing member 10, the buffering member 20, the sponge 21 and the weather strip 30 are preferably assembled with each other in a longitudinal direction from the ends thereof, and they are assembled with a reinforced glass 15 in a horizontal direction. In such a situation, silicon or adhesive agent is filled in the silicon space 11*a* of the fixing member 10 so as to get a steadfast fixing.

Figure 3:
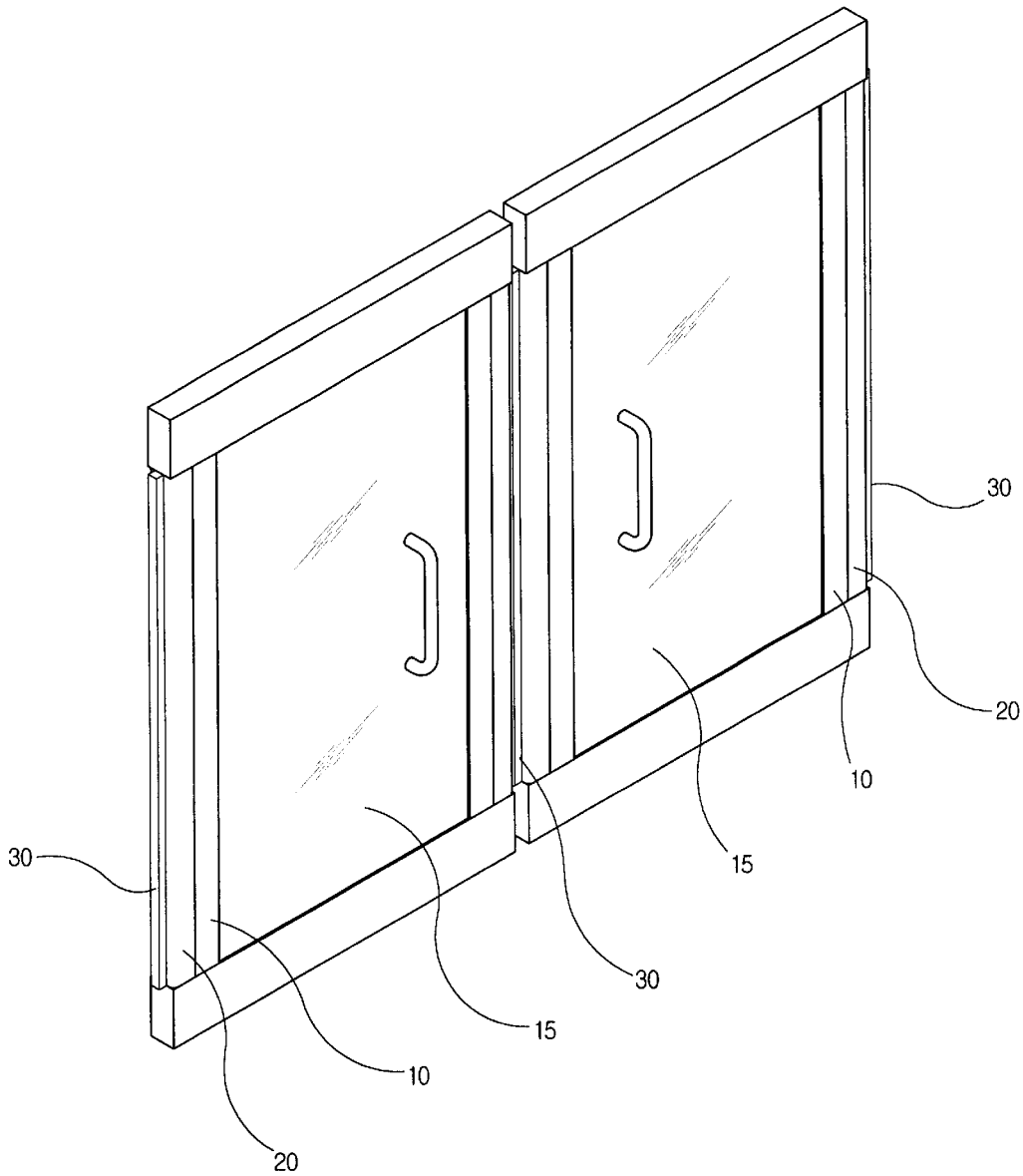
FIG. 3 is a perspective view of a glass door according to the present invention showing the assembled state.
Figure 4:
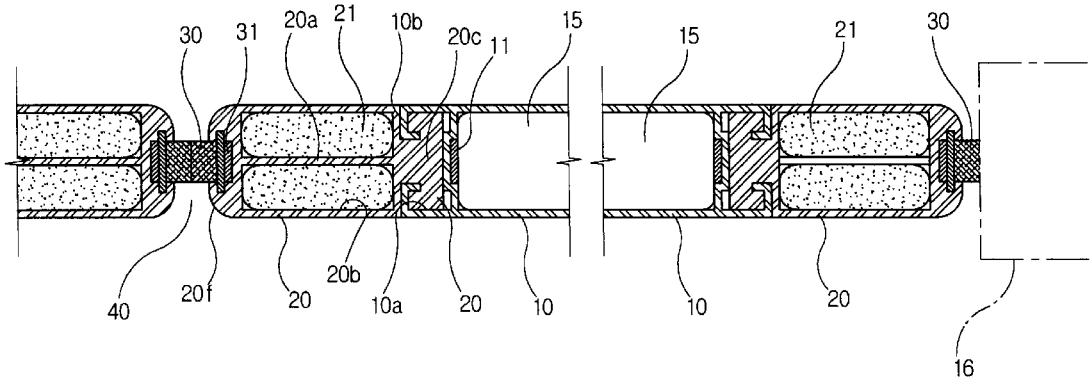
FIG. 4 shows an example of installed state of the present invention.
Figure 5A:
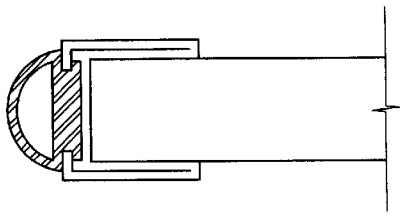
FIGS. 5A, 5B and 5C are cross sectional views of a conventional product.
Figure 5B:
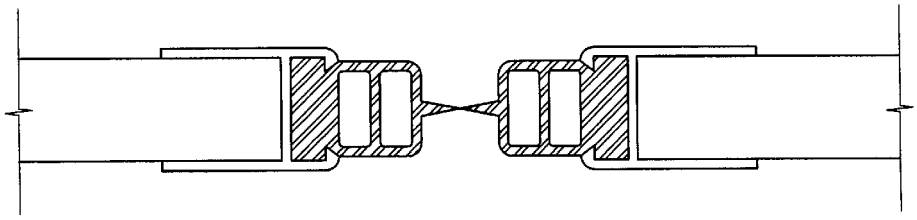
Figure 5C:
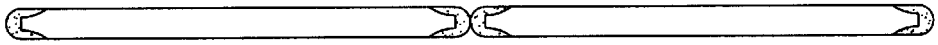

Meanwhile, as shown in FIG. 3, the weather strip 30 can be divided into two parts, that is, a part contacted with a frame of door (or a post), and a part contacted with another weather strip 30. In both the cases, the airtight sealing can be maintained reliably, and the noise which may be caused by the interference does not occur. To the contrary, in the conventional product shown in FIG. 5 where the sealing of the projecting ribs is kept according to the prior art, frictional noise occurs inevitably due to the interference between the contacted surfaces while the door is being opened or closed. Furthermore, if the projecting ribs are not arranged in a line exactly, the airtight sealing becomes impossible in fact.

As described above, according to the present invention, a buffering material such as a sponge having elasticity and buffering function is assembled on both end sides of the glass door made of a reinforced glass, and a weather strip for airtight sealing is assembled on the frontal edge side of the buffering material. Thus, the wound in finger of a child, which may occur by the closing of the door, can be prevented. Further, the windshield and the soundproof is maintained continuously, and the noise caused by the interference of the seal when the door is opened and closed can be reduced.

Although the preferred embodiment of the present invention has been described, it will be understood by those skilled in the art that the present invention should not be limited to the described preferred embodiment, but various changes and modifications can be made within the spirit and the scope of the present invention. Accordingly, the scope of the present invention is not limited within the described range but the following claims.

What is claimed is:

1. A safeguarding device of a glass door 15 serving functions of windshield, soundproofing and safety, the safeguarding device comprising:

a fixing member 10 having substantially U-shaped cross section, the fixing member 10 having an fitting space 11*b* with which an edge side of the glass door 15 is assembled, the fitting space 11*b* having a silicon space 11*a* formed on an inner side wall thereof, the silicon space 11*a* being filled with silicon, wherein two assembly grooves 10*a* having T-shaped cross section is formed by assembly ribs 10*b* having L-shaped cross section, on a side opposite to the fitting space 11*a;* a buffering member 20 having another assembly ribs 20*g* assembled with the assembly grooves 10*a,* the assembly ribs 20*g* being formed on a side 20*c* thereof having T-shaped cross section, the buffering member 20 having two buffering spaces 20*b* of almost a rectangular shape which are spaced by a central partitioning wall 20*a* formed on a central area thereof; and a weather strip 30 assembled with a fixing groove 20*d* having T-shaped cross section, so as to provide airtight sealing.

2. The safeguarding device of claim 1, wherein a buffering material 21 is inserted into the buffering spaces 20*b* of the buffering member 20.

* * * * *